US005511794A

United States Patent [19]

Katamoto

[11] Patent Number: 5,511,794

[45] Date of Patent: Apr. 30, 1996

[54] COIN GAME MACHINE REQUIRING PLAYER SKILL

[75] Inventor: Tohru Katamoto, Saitama, Japan

[73] Assignee: American Sammy Corporation, Elk Grove Village, Ill.

[21] Appl. No.: 305,450

[22] Filed: Aug. 31, 1994

[51] Int. Cl.[6] ..... A63F 9/00

[52] U.S. Cl. ..... 273/440; 273/454; 273/126 A; 273/127 R

[58] Field of Search ..... 273/118, 123, 273/124, 119, 126, 127, 138 R, 138 A, 440, 454

[56] References Cited

U.S. PATENT DOCUMENTS

| | | | |
|---|---|---|---|
| 2,926,915 | 3/1960 | Johns | 273/118 A |
| 3,476,391 | 11/1969 | Fejko | 273/124 R |
| 3,825,265 | 7/1974 | Pitkanen et al. | 273/138 R X |
| 5,137,278 | 8/1992 | Schilling et al. | 273/119 A X |
| 5,275,402 | 1/1994 | Malavazos et al. | 273/138 A |
| 5,292,127 | 3/1994 | Kelly et al. | 273/138 R |
| 5,297,816 | 3/1994 | Becchio | 273/138 A X |

*Primary Examiner*—Raleigh W. Chiu
*Attorney, Agent, or Firm*—Laff, Whitesel, Conte & Saret, Ltd.

[57] ABSTRACT

A carousel of rotating arms provides a circular excursion, raising and lowering the arms at fixed locations in the excursion. A target is carried by each arm. A coin chute drops coins at a location where the target passes. The player skill is to roll a coin down a coin chute so that it drops off the end thereof at the instant when a target is positioned to catch it. If desired, the targets may be shaped to require different skill levels by the person who rolls the coin. A microprocessor controls the game machine and pays off according to a programmed schedule. The operational parameters of the game machine may be changed by software adjustments.

24 Claims, 3 Drawing Sheets

COIN GAME MACHINE REQUIRING PLAYER SKILL

This invention relates to coin game machines requiring player skill and more particularly to coin redemption or jackpot type of game machines offering a wide range of interests to players having different skill levels.

There are many game machines ranging from a child's game machine to a casino gambling machine. In the end of the spectrum featuring a child's game machine, the emphasis is on an entertaining machine with interest enhancers such as whistles and bells, an attractive ambience, and imagination stimulants. At the other end of the spectrum, the casino game machine places its emphasis on the pay-out of a coin redemption game when there is either a hit or a jackpot. It would be desirable if a single design would lead to game machines extending over this entire spectrum.

Another consideration is that there are many game machines already available to the public such as pinball machines, jackpot machines, and the like. Therefore, if a new machine is to be successful, it should be different and should provide a point of interest which has not been available heretofore.

Still another consideration is that a successful game machine should provide a flexibility of design. Here, the game arcade or owner of the machine should be able to quickly and easily adjust operational parameters of the machine, such as: the odds, the payout, the timing required to play, and the like. For all of these and similar considerations, such a game machine should be very simple to construct at a very low cost.

Accordingly, an object of the invention is to provide new and novel game machines which may be constructed at a relatively low cost in a great variety of designs. Here, an object is to provide such a game machine controlled by a microprocessor so that operational parameters such as the pay-off, scoring, etc. may be changed quickly and easily by making software adjustments. In this connection, an object is to provide game machines which pay-off in greater or lesser amounts as skill levels increase or decrease so that there is an inducement to go on playing regardless of the player's skill level.

In keeping with an aspect of the invention, these and other objects are accomplished by a rotating device which has "arms" that can catch coins if they appear and drop onto the revolving arm with a precise timing. The game may be constructed so that either one player skill level or a plurality of skill levels are used. For example, if a single coin is caught, there might be one pay-out, or there might be a plurality of pay-outs depending upon which arm caught the coin and the skill level required for the catch. If a selected number of coins are caught in succession during a predetermined time period, there may be a jackpot pay-out based on a certain percentage of all coins then in the machine. The game machine includes a microprocessor which keeps track of all aspects of the game machine. Therefore, by relatively simple software adjustments the rate of pay-out, or any other operational parameter of the game machine, may be changed.

A preferred embodiment of the invention will be understood from the following specification taken with the attached drawings, in which.

Figure 1:
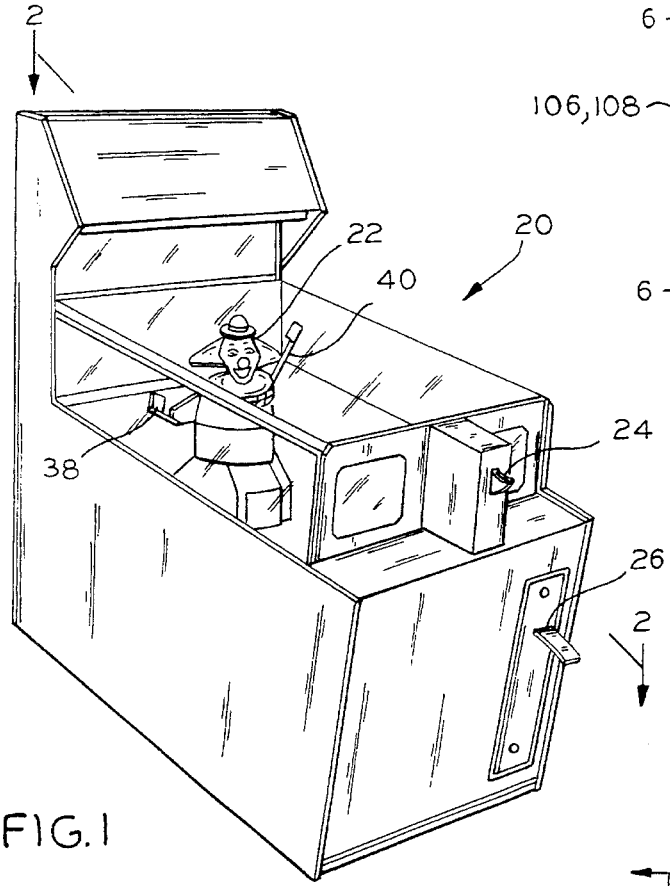
FIG. 1 is a perspective view of an exemplary one of the inventive game machines.
Figure 5:
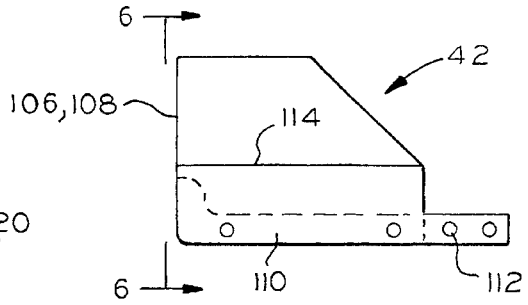
FIG. 5 is a side elevation of a coin catching target which is decorated to be a "hand" of a clown.

FIG. 1 shows the exterior player's eye view of an exemplary inventive coin redemption game machine 20 which in this case, features a circus theme or ambience with a three dimensional clown 22. Other machines could feature different themes. For example, the circus theme might also feature an animal wearing a circus attire. Or, a zoo theme might also be served by a three dimensional animal.

As will become more apparent, game machine 20 is a mechanism in which a player manipulates a game piece, here a coin, token, chip or the like in order to demonstrate the level of the player's skill. The player's skill requires a coordination of a position of the game piece relative to the position of the clown's arm, taken with respect to time. If the player is successful in manipulating the playing piece, a coin, token, chip, ticket or jackpot is paid out to the player.

The circus game of FIG. 1 has a bright, colorful, 3-dimensional, circus theme clown 22 which is the center of attention in a mirror-lined cabinet. The clown 22 holds out four equally spaced arms which rotate in a circle and which move up and down at predetermined places during each complete rotation. Each arm may or may not represent a different value of coin, token, ticket or other suitable scoring value which may be set to reflect one or a plurality of different difficulty levels. As the clown arms rotate, calliope music plays and a circus barker calls to the player. A coin drop slot 24 has a suitable slug detector associated therewith in order to reject fraudulent coins. A ticket 26 is issued in a value denomination or number to reflect the winnings. Of course, any other suitable form of a counter or marker may be substituted for the tickets. When the coin is dropped, a timer starts a countdown for a predetermined time period, such as sixty seconds, for example.

Briefly, at the sound of a drum roll, for example, a player can test his skill by dropping a coin or token and trying to have a "hand" on one of the rotating clown arms "catch" the coin. If a player successfully coordinates a coin drop with a clown hand position, a first lamp in a bank of lights on a bonus wagon lights. Also, if the coin is caught by the clown's hand, a redeemable counter or marker (such as a ticket, token, coin, or chip) may be paid out to the player. If enough coins are caught during the measured time period, the player may win a jackpot. If the player misses the shot so that the coin or token is not caught by the clown, the coin drops into a bonus wagon where it is part of or becomes a measure for an accumulated jackpot. Then, the clown laughs and taunts the player telling him to try again.

This combination of a game requiring a player skill level with a jackpot adds a whole new dimension to game machines. The players may continue to test their skill, but usually they have only the predetermined time period (60 seconds in one example) to make a suitable number of coin "catches". If any player successfully makes a predetermined number of catches (such as five caught coins during the predetermined time period), the bottom of the bonus wagon opens and lets down a cascade of coins, paying out a jackpot. Or, preferably, the jackpot may be paid out in suitable counters such as tokens, bonus tickets, or chips.

If it is desirable, software adjustments may be made to substitute something else for the time limit. For example, if there is no time limit, the lights remain lit. Then, a machine with four of five lights lit becomes a magnet that draws other players who want to light the fifth light and win the jackpot.

The inventive game is controlled by software which stores a memory of the wins, losses, amount of money, coins, tokens, or the like, in the bonus wagon. Hence, the game is completely operator adjustable for both bonus pay-out and individual ticket values. In the alternative, the game software can be adjusted for no ticket or other pay-out operation for those locations that do not allow a coin redemption game.

Figure 2:
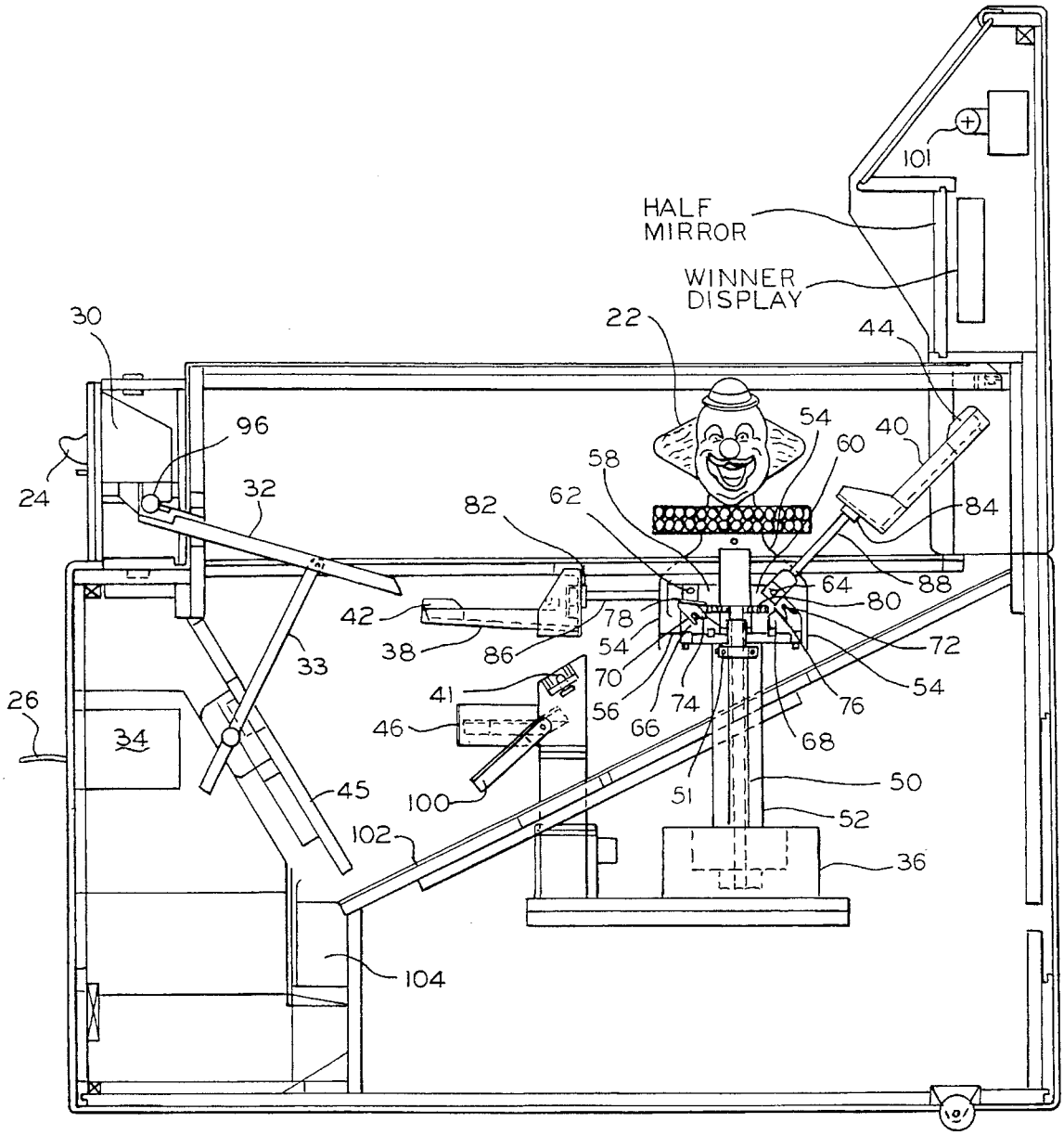
FIG. 2 is a cross section of the game machine taken along line 2—2 of FIG. 1.
Figure 10:
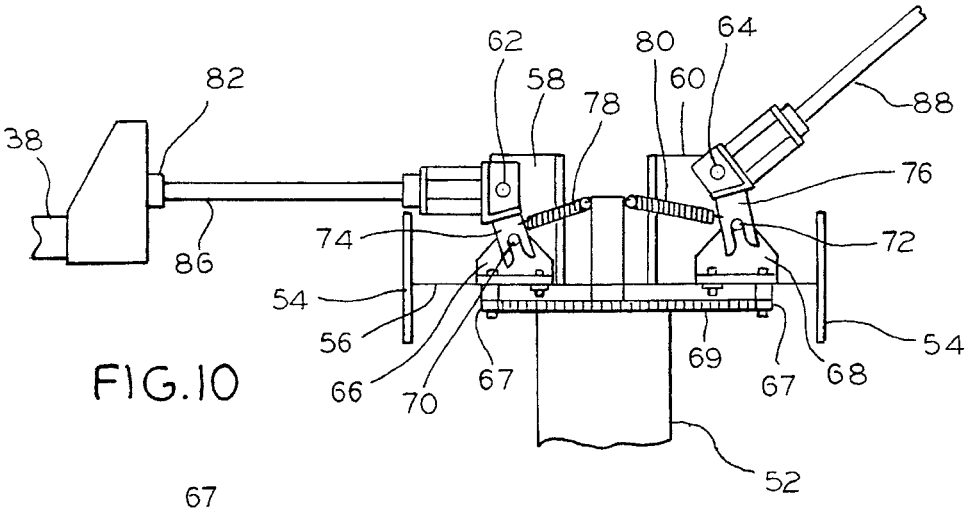
FIGS. 10 and 11 show the operation of the arms as they move through a circular excursion.

FIG. 2 is a cross section of the game machine taken along line 2—2 of FIG. 1. A coin drop 24 leads through a slug rejector 30 to a coin track 32. If the coin does not pass a suitable number of tests, slug rejector 30 returns it to the player. An adjustment at 33 enables the coin chute 32 to be aimed directly at the coin catching mechanism 42 forming a "hand" on the end of each clown arm. The skill is to roll a coin down chute 32 at the exact time required for the clown's arm to catch it as it leaves the end of the coin chute 32.

A suitable microprocessor 34 counts and registers each deposited coin and each successful catch of a coin, and also controls the other activities of the machine. It decides when and how much to pay out when a counter or marker 26, or a jackpot is issued.

A suitable carousel mechanism 36 turns the four arms (two of which 38, 40 are visible in FIGS. 1 and 2) which rotate around a circular track, endless as long as the machine is powered. Each arm terminates in a target 42 or 44, forming the clown's "hands", to catch the coin. The arms move from a lowered or coin catching position (as at 38; FIG. 2) to a raised coin disposition position (as at 40). When the arm completes its excursion around the circular path, it returns from its raised position 40 to its lowered position 38. Any caught coin is dropped on to an inclined surface 102 leading to a coin collection bin at the time when the arm goes up. Beneath the point where the hands may catch a coin is a "bonus wagon" 46 which is decorated in the circus ambience. On the bonus wagon, a score keeping bank of lights 41 light selectively to indicate when coins are caught. The bonus wagon provides means for bulk storing coins which are not caught.

The carousel mechanism (suitable motor, gears, etc.) 36 is coupled to turn a vertically oriented shaft 50 which is suitably and rotatably supported by bearing 51 at the top of an outer tubular stationary housing or pipe 52. The clown 22 is a doll head at the top of an inverted cup shaped member 54 mounted on the top of housing 52. A base plate 56 rotated by shaft 50 is inside the cup and has four support members formed by spaced parallel vertical plates, two of which are seen at 58 and 60. Each of the arms 38 and 40 is pivotally attached at 62 and 64 to an individually associated support 58 and 60.

The arms 38 and 40 are attached in any suitable manner to shafts 86 and 88, at points 82 and 84.

Near the attached end of each arm is a movable lower support member 66 and 68 having pins 70 and 72 for receiving forked, stabilizing and control plates 74 and 76 attached to the shafts 86 and 88. Attached to the bottom of each of these lower supports 66 and 68 is a wheel, such as 67, which rolls along the profiled periphery of a stationary cam plate 69 attached to the top of the fixed tubular support or pipe 52. The forked control plates 74 and 76 ride on the pins 70 and 72 to cause the up and down motion responsive to movement of the lower supports while controlling and reducing unwanted lateral motion throughout the excursion of the arms. Coiled springs 78 and 80 connect the forked control plates 74 and 76 to the central post 50 in order to bias the arms in a direction which causes them to move reliably between the lowered position of arm 38 and the raised position of arm 40 at fixed positions in the circular excursion of the arms.

Figure 11:
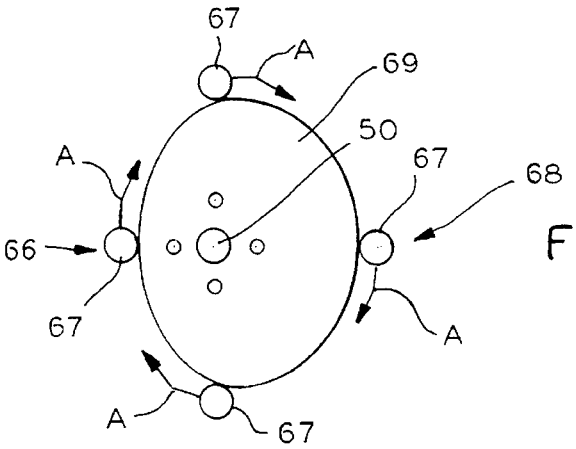

As the arms rotate (direction A, FIG. 11) through their excursion about the center axis of revolving post 50, cam 69 causes the wheels to move lower support members 66 and 68 between a position near the center of the cup 54 (as shown at 66) and a position near the perimeter of the cup (as shown at 68). As movement of the lower supports 66 and 68 occurs, the forked control plate 74 causes spring 78 to contract in order to pull arm 38 to a lowered position. When lower support member 68 moves toward the periphery of cup 54, spring 80 stretches and arm 40 moves up. As the arm moves from the raised position (as at 68), and the lower support 74 moves toward the center of the cup 54 (as at 66), the spring 78 contracts to pull the arm back to the lowered position, as shown at 38.

The construction of the coin track of arm 38 is seen in FIGS. 3, 4, 12 and 13. Two side plates 90 and 92 are separated by a center plate 94 and are secured together by rivets as shown at 97, for example. The thickness of center plate 94 is selected so that a coin 96 (FIGS. 2, 12 and 13) can roll freely between side plates 90 and 92. Pivotally attached to and between an upper position on side plates 90 and 92 is a pendulum 98 which acts as a coin brake. When rolling down the coin track of arm 38 (FIG. 13), a coin 96 strikes pendulum 98 and looses some of its speed as it pushes the pendulum aside and drops off the end of the coin track 38 and through space. A sensor 99 detects the passage of the coin and sends a signal to the microprocessor.

Figure 12:
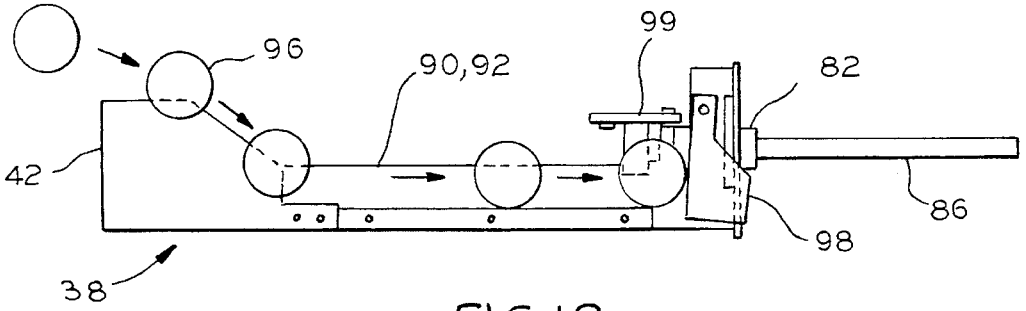
FIGS. 12 and 13 show the operation of a coin track in combination with a coin sensor or detector mechanism.
Figure 13:
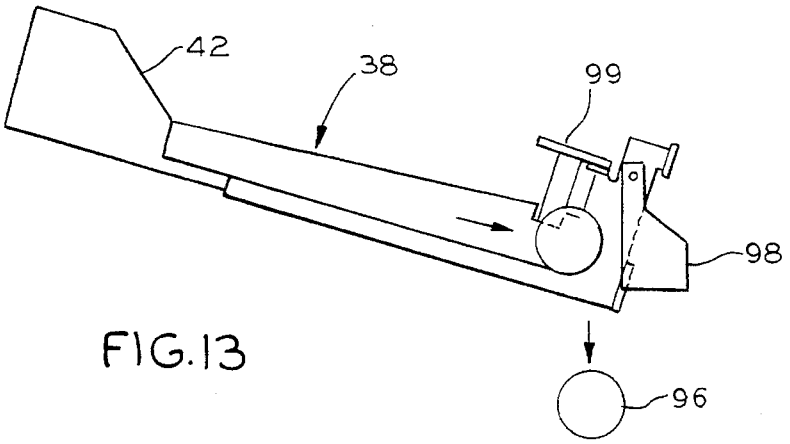

In greater detail, from FIGS. 2 and 12, the coin track of arm 38 is almost horizontal at the time when a dropped coin can be caught. The inertia causes the coin to roll to the end of the coin track; however, the pendulum 98 tends to slow or stop the coin. From FIG. 11, the arms move in direction A while the profile of cam plate 69 causes the wheel 67 at this coin catching position to roll away from center post 50. The lower arm support 66 moves outwardly toward the periphery of cap 54.

The coin track of arm 38 raises responsive to this cam operated movement of the lower arm support. As the coin track of the arm raises (FIG. 13), the weight of the coin 96 urges the pendulum 98 to swing outwardly, thus releasing the coin. As the coin passes sensor 99, a signal is sent to the microprocessor 34 (FIG. 1) which records a "hit". If the coin did not fall into a target and coin track, the microprocessor 34 would have received a signal when the coin was dropped into the coin slot 24, but not thereafter from sensor 99. Hence, the microprocessor would then record a miss after a suitable time period which is long enough for the coin to reach sensor 99.

If the coin 96 (FIG. 2) rolling down the coin track 32 misses the target 42 or 44 forming the clown's hands, it falls into "bonus wagon" 46. A "miss" may or may not be rewarded in any suitable manner, as by issuing a single ticket, token, chip, coin or the like, for example.

If the coin rolling down the coin track 32 falls into one of the targets 42, 44 formed by one of the clown's hands, there may be a different reward in the form of an appropriate number of issued tickets, tokens, chips, coins or the like, if different skill levels are used. The number of issued tickets, etc. depends upon adjustments made in the software. Also, suitable scoring lights 41 may be lit in the bonus wagon 46; or, other indicia may be given to show the success or lack thereof when the coin is either caught by the clown or dropped into the "bonus wagon". A florescent lamp 101 is mounted in a super structure in order to make a more interesting display at the top of the game machine.

The super structure of the top section of the game machine may have any suitable attention getting display. As here shown, there is a half mirror which reflects an image of an onlooking player, but is transparent to light from inside the housing. Accordingly, a "Winner Display" of lights inside the housing may light to give a rewarding display when any programmed event occurs. For example, a display might be the value of the jackpot, a congratulation message, an animation, or the like. Since the display is inside the housing, it is visible through the half-mirror.

The game may be set up by software adjustments in order to have almost any parameter such as how many "catches" or "misses" are required for a reward, how much time is allotted for the required number of catches or misses for a jackpot pay-out, what lights light or music plays, and the like. For example, if the player can score and light five bonus lights within a predetermined period of time, such as sixty seconds between each hit, the bottom 100 (FIG. 2) of the "bonus wagon" 46 drops. The dropped coins slide down an inclined floor chute 102 and into a coin collection bin 104. A coin counter delivers tickets equivalent to 80%, for example, of the coins accumulated in bin 104 as a jackpot pay-out.

The target 42 or 44 for the dropping coin is formed by two relatively wide side plates 106 and 108 separated by a relative narrow center strip 110, which are joined by rivets such as 112. The thickness of center strip 110 is slightly greater than the thickness of the coin which is to be caught so that the coin stands on its edge to roll out of the target 42, over the coin track on to inclined floor surface 45 or 102 (FIG. 2) and into a suitable collection bin 104, as the clown's arms 38, 40 move up.

Figure 6:
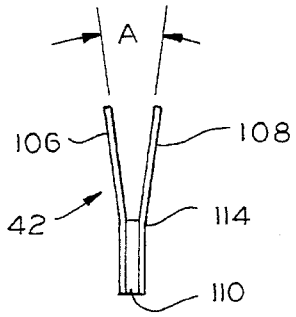
FIGS. 6–9 are four end views, each view being taken along line 6—6 of FIG. 5 and showing four targets, each requiring different degrees of player skill in order to catch a coin.
Figure 3:
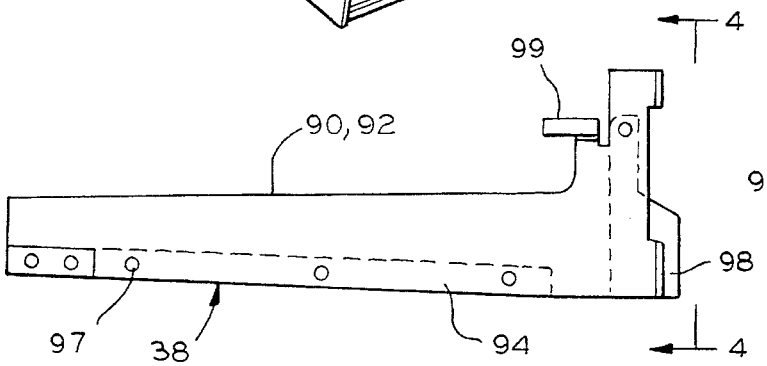
FIG. 3 is a side elevation of a coin chute.
Figure 4:
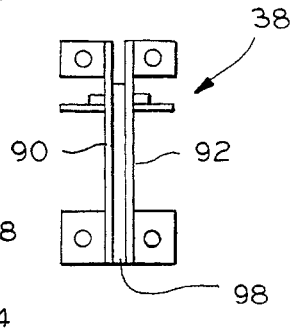
FIG. 4 is an end view taken along line 4—4 of FIG. 3.
Figure 7:
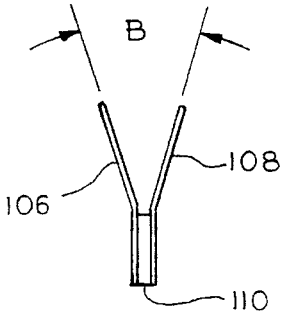
Figure 8:
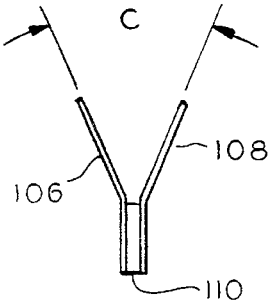
Figure 9:
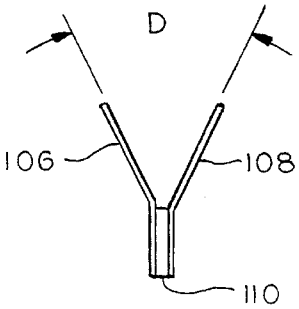

The two side plates 106 and 108 of the target are bent somewhat at 114 in order to provide a target with a cross section which flares outwardly as shown in FIGS. 6–9. The amount or degree of the bend at 114 determines the angle or amount of the flare and, therefore, the skill level required by the player in order to drop a coin into a target after it has rolled down and fallen off the end of coin chute 32 (FIG. 2). For example, FIG. 6 shows an angle A, in which the target may flare at an angle of perhaps 15°. FIG. 7 shows an angle B which might be a flare at an angle of 40°, for example. FIG. 8 shows an angle C which might be a flare at an angle of 50°, for example. FIG. 9 shows an angle D which might be a flare at an angle of 60°, for example.

Hence, the clown's "hand" with the 15° flaring target of FIG. 6 requires the highest skill level because it is the most difficult to hit by rolling a coin down chute 32. The "hand" with the 60° flaring target of FIG. 9 is the easiest to hit. The software may be adjusted to provide different pay-offs for the different clown "hands", depending upon the skill level required to hit the individual hand.

In operation, the game machine is connected to a suitable power source, usually a conventional commercial source of alternating current.

The stationary carousel 36 (FIG. 2) includes any suitable combination of motor and gears (not shown) which turn shaft 50 and cause the arms 38 and 40 to circle as long as the game is powered on. The arms drop and then rise again so that captured coins are deposited in a coin bin after a microprocessor has recorded a memory of the catch.

The player watches the revolving arm and, at a time which he selects, he drops a coin (or token) into the coin slot 24 of a suitable coin mechanism. A defective or fraudulent coin is rejected at this point. If the coin is acceptable, it is counted and registered in memory by the game's software. The coin 96 rolls onto the coin track 32 and into the play field area where the clown's revolving arms 38, 40 are located. When it reaches the end of the coin track 32, the coin 96 either falls into a target 42, 44 on one of the revolving arms and there is a "hit" or, the coin misses the target and falls into the "bonus wagon" 46 and there is a "miss". If there is a hit and the coin falls into a target on one of the revolving arms, an appropriate number of "tickets" or the like are dispensed at 26. If the coin falls into the "bonus wagon" 46, there is a miss and, perhaps only one ticket is dispensed. These numbers can be adjusted by changing the game software.

Assuming that the player makes a successful hit by dropping a coin into a target on one of the arms, a bonus light 41 lights on the "bonus wagon" 46. At this point, the player can continue play and not only try to score another drop of a coin into a revolving arm, but also to light another bonus light 41. If the player can light, say, five, bonus lights in a row, within a predetermined time period, such as sixty seconds between each hit, the "bonus wagon" floor 100 drops open. These numbers and time limits can also be adjusted with game software.

Responsive to the drop of the bonus wagon floor 100, all of the coins that have been accumulating in the "bonus wagon" and that have been caught in the targets on the arms are collected into the cash box 104 in the game cabinet. When five bonus lights are illuminated, for example, the player is paid a jackpot or bonus in the amount of 80% of the number of coins that have been accumulated. This number can be adjusted with the game software.

Those who are skilled in the art will readily perceive how to modify the invention. Therefore, the appended claims are to be construed to cover all equivalent structures which fall within the true scope and spirit of the invention.

The claimed invention is:

1. A coin game machine comprising a revolving mechanism having a plurality of arms, each of said arms having a target associated therewith, a chute positioned to deposit a coin dropped off said chute and into said target if an arm of said revolving mechanism is properly positioned under said chute when said coin drops therefrom, and storage means for capturing coins which drop when said target is not properly positioned under said chute when said coin drops off said chute.

2. The game machine of claim 1 and microprocessor means for controlling said game machine, means associated with said microprocessor for storing a memory of each coin and the disposition thereof, and means responsive to programming said microprocessor for controlling a pay-off by said game machine in response to the skill level demonstrated by a player dropping coins onto said chute.

3. A game machine comprising a rotating carousel of arms, said arms raising and lowering at fixed locations in their circular excursion as said carousel rotates, each of said arms having a target associated herewith, a chute for guiding and directing a coin to a drop position over said targets as they pass with the rotation of said carousel of arms, means responsive to a coin dropping onto a target for storing a memory of a successful catch, means responsive to a coin failing to drop onto a target for storing a memory of an unsuccessful catch, and means responsive to said stored memory for giving a predetermined pay-out based on the skill level of a player as demonstrated by the number of coins that are caught.

4. The machine of either claim 1 or claim 3 wherein the target on at least one of said arms requires a first player skill level in order to drop a coin thereon, and the target on at least another of said arms requires a second player skill level in order to drop a coin thereon.

5. The machine of either claims 1 or claim 3 wherein each of the targets on said arms requires the same player skill level in order to drop a coin thereon.

6. The machine of either claim 1 or claim 3 wherein each of the targets on said arms requires a different player skill level in order to drop a coin thereon.

7. The machine of either claim 1 or 3 wherein each of said targets has a flared cross section with a wide dimension of said flare open to catch said coins, said chute being positioned to drop a coin into said wide dimension of said flare, there being at least two different flared angles in said targets so that different skill levels are required to drop a coin into said target.

8. The machine of claim 7 wherein each of said targets has a different flared angle.

9. The machine of either claim 1 or claim 3 and means responsive to a pre-selected player skill level for paying off a jackpot.

10. The game machine of either claim 2 or claim 3 and means for changing operational parameters of said machine in response to software adjustments.

11. A jackpot type of machine comprising a coin chute, a plurality of moving targets which are periodically presented to a position which coins reach as they fall off said chute whereby a player requires skill in order to cause a coin to fall off said chute and onto a target while it is at said position, storage means at said position to catch coins which do not reach said target, an inclined floor beneath said targets and said storage means for guiding and directing all coins falling thereon into a bin for accumulating said coins, coins reaching said target later falling onto said inclined floor after having been counted, means for measuring a predetermined period of time, means responsive to the counting of a predetermined number of said coins falling onto said target during said predetermined period of time for dropping the coins in said storage means onto said inclined floor and for thereafter selecting a predetermined percentage of coins in said bin for delivery to a player as a jackpot pay-out.

12. The machine of claim 11 and microprocessor means for controlling all operational parameters of said machine, and means for changing said operational parameters in response to said software adjustments.

13. The machine of any one of the claims 1, 3 or 11 and a brake for absorbing energy from coins falling on said target.

14. The machine of claim 13 wherein said coins falling on said target roll down a coin track associated with said target and said brake is a pendulum suspended in said coin track, said rolling coin striking and swinging said pendulum in order to reduce the inertia of the rolling coin.

15. A game machine for use with a coin, token, chip, or other disc-shaped game piece, the game machine comprising:

a housing having a playing space in the interior of the housing and an opening through which the disc-shaped gamed piece is insertable;

at least one member located in the playing space and periodically accessible to the game piece when the game piece is inserted into the housing at the proper time; and means for registering when the game piece accesses the member;

wherein the opening comprises a slot and wherein the member moves and is thereby periodically positioned near the slot.

16. The game machine of claim 15, wherein the member rotates.

17. The game machine of claim 15, wherein the member periodically changes vertical position within the playing space.

18. The game machine of claim 15 comprising a plurality of members extending radially outward and rotating about an axis, and wherein each of the members periodically changes vertical position within the playing space to align with the slot.

19. A game machine for use with a coin, token, chip, or other disc-shaped game piece, the game machine comprising;

a housing having a playing space in the interior of the housing and an opening through which the disc-shaped game piece is insertable;

at least one member located in the playing space and periodically accessible to the game piece when the game piece is inserted into the housing at the proper time;

means for registering when the game piece accesses the member; and a target secured to the member.

20. A game machine comprising:

a coin chute;

a plurality of moving targets which are periodically presented to a position which coins reach as they fall from the chute, whereby a player requires skill in order to cause a coin to fall off said chute and onto a target while it is at the position;

means for accumulating coins fallen from the chute;

means for measuring a predetermined period of time; and means for counting of a predetermined number of said coins reaching the targets during the predetermined period of time.

21. The machine of claim 20, further comprising means for delivering at least some of the accumulated coins as a jackpot.

22. The machine of claim 20, further comprising means for delivering a pay-out corresponding to the number of accumulated coins.

23. The machine of claim 20, wherein the pay-out comprises redeemable tickets.

24. A game machine comprising a rotating carousel of arms, the arms raising and lowering at fixed locations in their circular excursion as the carousel rotates, a chute for guiding and directing a coin to a drop position over the arms as they pass with the rotation of the carousel, means responsive to a coin dropping onto one of the arms for registering a successful catch, means responsive to a coin failing to drop onto any of the arms for registering a failure to catch, and means for giving a predetermined pay-out based on the skill level of a player as demonstrated by the number of coins that were caught.

* * * * *